US011260396B2

(12) United States Patent
Iamartino et al.

(10) Patent No.: US 11,260,396 B2
(45) Date of Patent: Mar. 1, 2022

(54) APPARATUS FOR THE MICRONIZATION OF POWDERED MATERIAL WITH THE CAPACITY TO PREVENT INCRUSTATIONS

(71) Applicant: Micro-Macinazione SA, Molinazzo di Monteggio (CH)

(72) Inventors: Piero Iamartino, Molinazzo di Monteggio (CH); Milko Leone, Molinazzo di Monteggio (CH); Salvatore Mercuri, Molinazzo di Monteggio (CH)

(73) Assignee: Micro-Macinazione SA

( * ) Notice: Subject to any disclaimer, the term of this patent is extended or adjusted under 35 U.S.C. 154(b) by 211 days.

(21) Appl. No.: 16/337,210

(22) PCT Filed: Sep. 28, 2017

(86) PCT No.: PCT/EP2017/074669
§ 371 (c)(1),
(2) Date: Mar. 27, 2019

(87) PCT Pub. No.: WO2018/060355
PCT Pub. Date: Apr. 5, 2018

(65) Prior Publication Data

US 2019/0291118 A1 Sep. 26, 2019

(30) Foreign Application Priority Data

Sep. 30, 2016 (IT) ..... 102016000098452

(51) Int. Cl.
*B02C 19/06* (2006.01)

(52) U.S. Cl.
CPC ..... *B02C 19/06* (2013.01); *B02C 19/061* (2013.01); *B02C 19/063* (2013.01)

(58) Field of Classification Search
CPC ..... B02C 19/06–068
See application file for complete search history.

(56) References Cited

U.S. PATENT DOCUMENTS 6,383,706 B1 * 5/2002 Kumar ..... B02C 19/068 241/25
2006/0257491 A1 * 11/2006 Morton ..... A61K 9/1617 424/489

(Continued)

FOREIGN PATENT DOCUMENTS

CN 102847596 A 1/2013
CN 204841875 U * 12/2015 ..... B02C 19/06

(Continued)

OTHER PUBLICATIONS

Office Action for Chinese Application No. 201780060547.2, dated Sep. 1, 2020 (w/English translation).

(Continued)

*Primary Examiner* — Adam J Eiseman
*Assistant Examiner* — Jared O Brown
(74) *Attorney, Agent, or Firm* — Klarquist Sparkman, LLP

(57) ABSTRACT

Apparatus (10; 110) for the micronization of a powdered material or product (P) comprising a micronizer mill (20), of the type with high-energy jets of a gaseous fluid, in turn comprising a micronization chamber (20*a*), in which micronization chamber the powdered material (P) is micronized as a result of the collisions between its particles caused by the high-energy jets (G) of a first gaseous fluid (A), such as nitrogen or air, wherein the micronization chamber (20*a*) of the micronizer mill (20) is delimited by walls (20*f*) which have at least one porous portion which is traversed by a regular flow (f1), of a second gaseous fluid (F), aimed towards the interior of the micronization chamber, so as to avoid the formation of incrustations and/or accumulations of powdered material in the same micronization chamber (20*a*). More particularly the micronization apparatus (10)

(Continued)

comprises a first outer annular chamber (20*b*) which extends around the micronization chamber (20*a*) and is fed by the first gaseous fluid (A) which generates the high-energy jets in the micronization chamber, and a second intermediate annular chamber (20*d*) which is associated with the porous wall (20*f*) which delimits the micronization chamber (20*a*) and is fed by the second gaseous fluid (F) aimed to flow through this porous wall, or, in a variant (110) of the micronization apparatus, comprises instead of the first annular chamber a system of channels (120*b*) which convey the first gaseous fluid which generates the high-pressure jets and extend through the annular chamber (120*d*) fed by the second gaseous fluid (F) which traverses the porous wall. Advantageously the apparatus of the invention (10; 110), avoiding the formation of incrustations and similar accumulations inside the micronization chamber (20*a*) of the micronization mill (20) and in the adjacent areas, improves the efficiency of the micronization process and the quality of the micronized end product and moreover considerably reduces the costs of maintenance with respect to conventional micronization mills and apparatuses, with high-energy jets of a gaseous fluid.

20 Claims, 9 Drawing Sheets

(56) References Cited

U.S. PATENT DOCUMENTS

| | | | | |
|---|---|---|---|---|
| 2013/0341438 | A1 | 12/2013 | Kozawa et al. | |
| 2014/0275517 | A1* | 9/2014 | Kazmi | A61K 9/14 536/123.13 |
| 2015/0083830 | A1 | 3/2015 | Leone et al. | |

FOREIGN PATENT DOCUMENTS

| | | | |
|---|---|---|---|
| CN | 204841875 | U | 12/2015 |
| CN | 109789424 | A | 5/2019 |
| EP | 3519100 | B1 | 9/2020 |
| IT | 201600098452 | A1 | 3/2018 |
| JP | S62273061 | A | 11/1987 |
| JP | H1028857 | A | 2/1998 |
| JP | 2004243317 | A | 9/2004 |
| JP | 2005131633 | | 5/2005 |
| JP | 2011219292 | A | 11/2011 |
| JP | 2016515931 | A | 6/2016 |
| JP | 2017127824 | A | 7/2017 |
| JP | 2020500105 | A | 1/2020 |
| TW | 201247324 | A | 12/2012 |
| WO | WO2018/060355 | A1 | 4/2018 |

OTHER PUBLICATIONS

International Search Report and Written Opinion for PCT/EP2017/074669, dated Dec. 20, 2017.

* cited by examiner

APPARATUS FOR THE MICRONIZATION OF POWDERED MATERIAL WITH THE CAPACITY TO PREVENT INCRUSTATIONS

CROSS REFERENCE TO RELATED APPLICATIONS

This is the U.S. National Stage of International Application No. PCT/EP2017/074669, filed Sep. 28, 2019, which was published in English under PCT Article 21(2), which in turn claims the benefit of Italian Application No. 102016000098452, filed Sep. 30, 2016, which is incorporated herein in its entirety.

TECHNICAL FIELD OF THE INVENTION

The present invention relates in general to the area of devices and apparatuses for the micronization of powdered material, that is for the grinding and crushing of powdered materials and similar substances in order to transform them into a finer micronized powder, and in particular its object is an apparatus for the micronization of a powdered product or the like, which specifically comprises a micronizer mill of the type with high-energy jets of a gaseous fluid and which offers improved performances and features aimed at preventing the formation of incrustations and deposits inside the micronizer mill during use to micronize the powdered material.

The present invention also relates to a corresponding process for the micronization of powdered material or a similar product, which provides for the use of a micronizer mill of the type with high-energy jets of a gaseous fluid and which has the advantage of effectively preventing the formation of incrustations and other accumulations of powdered material inside the micronizer mill which could create serious problems and disadvantages during its use for micronizing the powdered product.

BACKGROUND OF THE INVENTION AND STATE OF THE ART

The current technology for the grinding and micronization of powdered material and in general of powders, for example made up of powdered compounds for a use in the pharmaceutical industry, offers numerous solutions, also alternative one to the other, among which mention is made in particular of the systems of micronization of powders based on the use of a mill with high-energy jets of a gaseous fluid, also referred to as "spiral mill" or "jet mill".

These jet mills normally comprise a grinding or micronization chamber, circular in shape, or the like, where a series of jets, with high energy, act, generated by a compressed gaseous fluid, such as typically air or nitrogen, which draw and stir the particles of the powdered product and cause a continuous collision between them and therefore their micronization into finer and smaller particles.

These jet mills also usually comprise a system of selection or classification, of the static or dynamic type, associated with a central area of the micronization chamber and apt to classify and separate selectively on the basis of their grain size the crushed and micronized particles.

More specifically, during the functioning of these jet mills, the particles, stirred and drawn by high-energy jets of the gaseous fluid which are generated and act inside the micronization chamber, are subject to a centrifugal force which also determines a selection thereof, so that the finer and already micronized particles tend to move towards the inner central zone of the micronization chamber, from where they are evacuated, while those of greater dimensions, not yet micronized, tend to remain in the outer peripheral area of the micronization chamber and therefore to rotate around the axis of the latter, thus undergoing further collisions, until, through the effect of these further collisions, they reach a certain fineness and sufficient micronization so that they are drawn back towards the central area of the micronization chamber and then evacuated.

Despite the improvements which during the years have involved micronization apparatuses and corresponding processes, at the present time some problem are still unsolved or at least appear to have been solved in a not wholly satisfactory manner, so as to require further improvements in these apparatuses and processes of micronization.

More particularly, among these unsolved problems, mention is made of the important one of the formation of undesirable incrustations and accumulations of powdered material, in particular during micronization of certain types of powdered material, in critical zones and surfaces inside the micronization chamber, which have the effect of reducing the productivity of the apparatus of micronization and also entail having to intervene periodically to remove these incrustations and accumulations of powdered material, with a considerable increase in maintenance costs.

Among the powdered substances which, as has been observed experimentally, are subject during their micronization in a high-energy jet mill to the disadvantage of the formation of incrustations and accumulations on the walls of the micronization chamber of the jet mill the following substances are cited as an example: Flutamide, Acitretin, Fluticasone, Isoconazole, Isosorbide mononitrate, Nifedipine, Orlistat, Medroxyprogesterone acetate, Triamcinolone, Desogestrel and Eplerenone, and some types of steroids.

Naturally the list above is not to be considered limiting, so that other substances, not mentioned here, can have the disadvantage of generating incrustations during their micronization, so that the present invention could have a useful and advantageous application also in relation to these other substances.

It is also true that solutions have been studied and systems set up to prevent the formation of these incrustations and accumulations of powdered material inside the micronization chamber.

However these solutions and systems, known and in use, still have limits and disadvantages which need to be overcome and solved with appropriate improvements and perfections of the micronization apparatuses currently known.

For example the U.S. Pat. No. 3,856,214 proposes a device for the micronization of powdered material comprising a micronization mill in which the powdered material, to be micronized, is subjected to a vortex motion due to the action of a gaseous fluid, so as to cause the crushing of the particles of the powdered material into finer particles, in which the micronization mill in turn comprises a screen which is placed in an outlet duct which conveys the fine particles, already micronized, outside of the mill, and has the specific function of avoiding incrustations and accumulations of powdered material in the zone of this outlet duct.

However this device too for micronization of powdered material is not free from limitations and disadvantages, and in particular the solution, comprising a screen, adopted in this micronization device known from U.S. Pat. No. 3,856,214 appears limited to avoiding and preventing the formation of incrustations and accumulations of powdered material only in a restricted area, of outlet, of the micronization mill, and also constructionally somewhat complex and in any case involving an additional part, precisely constituted by a screen, so as to entail also a non-negligible cost.

OBJECTS AND SUMMARY OF THE INVENTION

Therefore a first object of the present invention is to make a new improved apparatus, for the micronization of powders, of the type comprising a mill with high-energy jets of a gaseous fluid, such as typically nitrogen or air, which is able to avoid the disadvantages, illustrated previously and present in the prior art, and which therefore has the capacity to prevent the formation of undesirable incrustations and/or accumulations of powdered material inside the jet mill and therefore also to avoid having to intervene periodically to remove these incrustations and accumulations from the same jet mill.

A further and second more general object of the present invention is also that of increasing the efficiency of a process of micronization of powders and similar materials which typically use a mill with high-energy jets of a gaseous fluid, avoiding those phenomena, such as the formation of accumulations and incrustations in the jet mill which, as is known, have a negative influence on and reduce the efficiency and the productivity of the micronization process.

Again a third object of the present invention is that of preventing and avoiding the formation of incrustations and accumulations of material on the surfaces of the micronization chamber of a jet mill, during the micronization of specific powdered substances which, as has been observed experimentally, are particularly critical and subject more than others to these phenomena of formation of incrustations and formation of accumulations of powdered material.

The aforementioned objects can be considered achieved in full by the apparatus for the micronization of powders having the features defined by the independent claim 1 and by the corresponding process for the micronization of powders having the features defined by the independent claim 9.

Particular embodiments of the present invention are defined by the dependent claims.

Advantages of the Invention

The advantages are numerous, in part already implicitly stated previously, which are associated with the new apparatus, according to the present invention, for the micronization of powders, such as those listed here below purely by way of example:

- a greater quality in general of the micronized product with respect to that which can be obtained with conventional apparatuses;
- a considerable reduction in maintenance costs of the micronization apparatus;
- a greater efficiency and quality of the micronization process, in particular of important substances widely used in the pharmaceutical industry;
- possibility of using different gaseous fluids as a function of the features of the powdered material which has to be micronized and the formation of incrustations whereof is to be avoided;
- a simple and easy-to-make construction;
- possibility of making new micronization equipment by adapting with relatively simple and non-complex modifications a micronization apparatus of a conventional type.

BRIEF DESCRIPTION OF THE DRAWINGS

These and other objects, features and advantages of the present invention will be made clearer and more evident by the following description of one of its preferred embodiments, given by way of a non-limiting example with reference to the accompanying drawings, of which.

Figure 1:
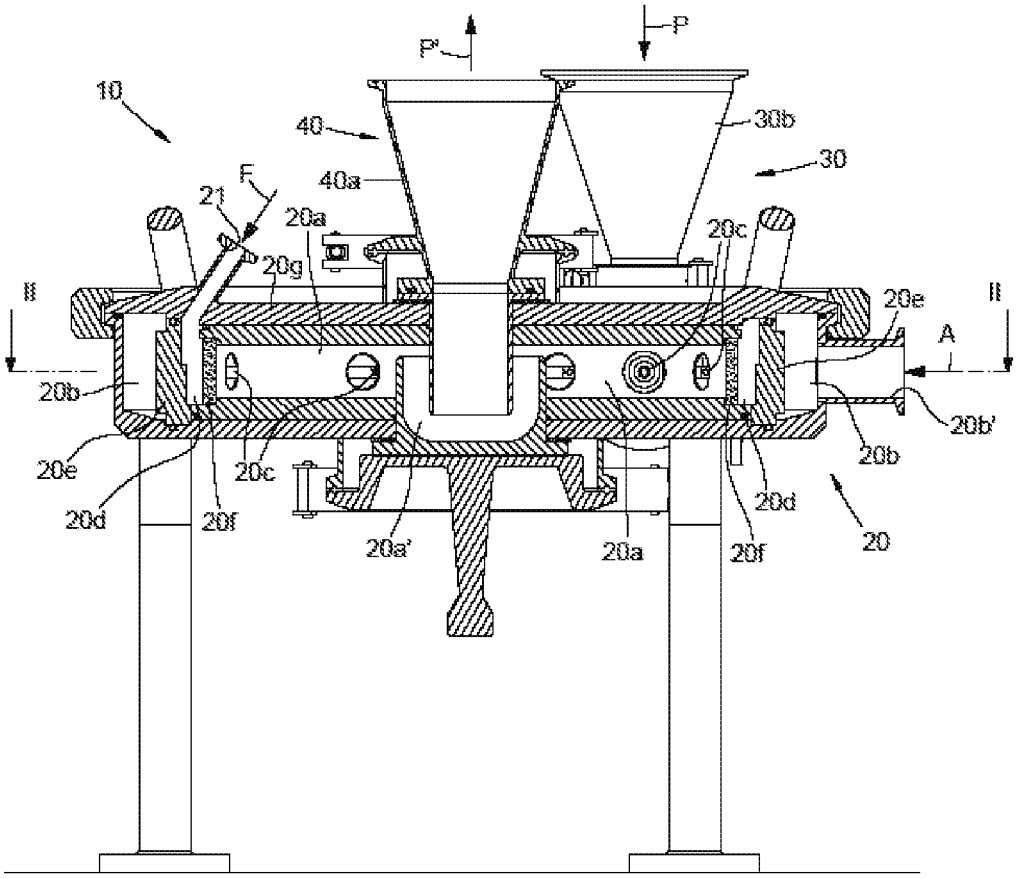
FIG. 1 is a partial schematic view sectioned along the vertical plane defined by line I-I of FIG. 2 and FIGS. 5A and 5B, of an apparatus, according to the present invention, for the micronization of powdered material, comprising a micronizer mill, of the type with high-energy jets of a gaseous fluid, having the capacity to prevent the formation of incrustations and accumulations of powdered material inside the same micronizer mill.

DESCRIPTION OF A PREFERRED EMBODIMENT OF THE MICRONIZATION APPARATUS OF THE INVENTION

Referring to the drawings, an apparatus or plant, according to the present invention, for the grinding or micronization of a material containing and formed by particles to be micronized and typically constituted by a product, a compound, a substance or in general a material P in powdered form, is denoted overall by 10 and comprises:

a micronizer mill, denoted overall by 20, of the type with high-energy jets of a gaseous fluid, such as typically air;

a feed system, denoted overall by 30, for feeding the powdered material P, to be micronized, to the micronizer mill 20; and a system of collection and evacuation, denoted overall by 40, for collecting and evacuating the micronized powdered material, denoted by P', or the powdered material P after it has been micronized by means of the micronizer mill 20.

The micronizer mill 20, with high-energy jets, also often referred to as "jet mill", has substantially known basic structural and operative features, which will therefore be described briefly and are to be considered part of the set of knowledge of persons skilled in the art.

More particularly the micronizer mill 20 comprises:

an inner micronization chamber 20*a*, with circular shape, also referred to simply as grinding or micronization chamber, an outer pressure chamber 20*b*, with annular shape, also referred to simply as pressure chamber, which surrounds the inner micronization chamber 20*a*, with annular shape, and is provided in order to be fed by a pressurised fluid through an inlet aperture or mouth 20*b*' of the same outer pressure chamber 20*b*; and a plurality of ducts or through holes 20*c*, appropriately slanted with respect to the radius of the micronization chamber 20*a*, which connect the outer pressure chamber 20*b*, to the inner micronization chamber 20*a* and through which the pressurised fluid coming from the outer pressure chamber 20*b* is conveyed into the inner micronization chamber 20*a*, so as to generate, inside the latter, the high-energy jets that cause the micronization of the powdered material P.

The slanted ducts or through holes 20*c*, which communicate the outer pressure chamber 20*b* with the inner micronization chamber 20*a*, can be made in various shapes and be part of different combinations.

Figure 2:
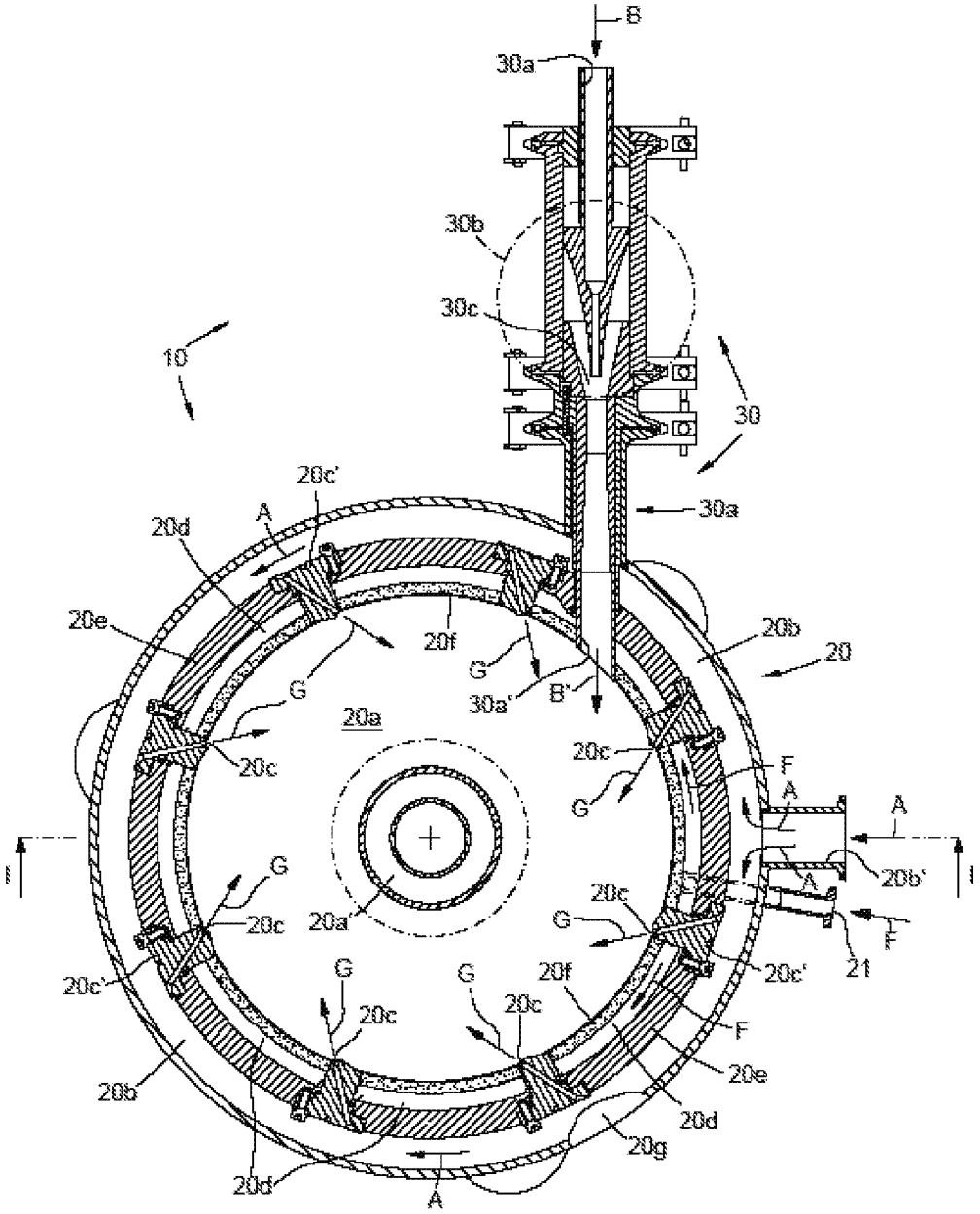
FIG. 2 is a partial schematic view sectioned along the horizontal plane defined by line II-II of FIG. 1 and of FIGS. 5C and 5D, of the apparatus, according to the present invention, for the micronization of powdered material.

For example they can be constituted by simple through holes without being formed in additional parts or elements, which extend and traverse the area, or the wall or the walls usually in Teflon®, which separates the pressure chamber 20*b* and the micronization chamber 20 one from the other, in particular in micronization mills of small size, such as those with micronization chamber of diameter of approximately 100 mm, or can be integrated in actual nozzles, provided with a metal body 20*c*', as shown in FIG. 2, in the case of micronization mills of greater size, such as those with micronization chamber of the diameter of approximately 300 mm.

The feeding system 30, also with substantially known features, comprises in turn:

a feed duct 30*a* which penetrates the interior of the micronizer mill 20 and in particular extends through the respective outer annular chamber 20*a* and the respective intermediate annular wall 20*c*, in order to feed the powdered material P, to be micronized, to the inner micronization chamber 20*b* of the micronizer mill 20, as described in greater detail here below; and a hopper 30*b* which is filled with the powdered material P to be micronized, as indicated by a corresponding arrow P in FIG. 1, wherein this hopper 30*b* is usually associated with a Venturi tube, denoted by 30C, in turn integrated and defined by the feed duct 30*a*.

The collection and evacuation system 40, also with substantially known features, has the function of collecting and evacuating from the micronizer mill 20 the micronized powdered material P', or the powdered material P once micronized, which concentrates in fact in the central area of the micronization chamber 20*a*, as described in greater detail here below.

Normally the collection and evacuation system 40 is associated with a classifier, of known features and therefore not shown in the drawings, having the function of classifying or selecting the particles of the micronized powdered material P', on the basis of their dimensions and grain size, so as to evacuate from the micronizer mill 20 only the particles which have reached a certain level of micronization.

This system of collection and evacuation 40 can have various configurations, in particular as a function of the product type which has to be micronized.

For example, as shown in FIG. 1, the collection and evacuation system 40 can comprise a collector member 40*a*, vaguely in the shape of a hopper, which is associated at a respective lower end with the central area of the micronization chamber 20*a*, so as to collect the micronized product which exits upwards, through the classifier, in the direction of an end collection cyclone.

Or, alternatively, the system of collection and evacuation 40 can be configured so as to collect the micronized product which exits and flows from the micronization chamber downwards, so that the classifier which receives the micronized particles is open downwards and the micronized product is collected under the mill.

In this alternative configuration, in which the micronized product is collected under the mill, the collection and evacuation system 40 comprises in any case always an opening upwards to allow the release of the gas coming from the micronization chamber, so that this gas which is released and exits upwards will contain a certain quantity, even if in a minimal percentage, of micronized particles, which therefore will be lost.

In the functioning of the micronization apparatus 10, the feed duct 30*a* of the feed system 30 is fed from the outside with pressurised air, denoted in the drawings by B, so as to create a flow of air which flows along the feed duct 30*a* and which, while it traverses the zone of the Venturi tube 30*c*, creates a vacuum which draws back the powdered material P from the hopper 30*b*, so as to generate a flow of air, indicated by an arrow B' in the drawings, which draws the particles of the powdered material P to be micronized and feeds them, through an outlet opening 30*a*' of the feed duct 30*a*, to the inner micronization chamber 20*a* of the micronizer mill 20, so that the particles are micronized.

Moreover, simultaneously, the micronizer mill 20 is fed with a fluid, in particular air or nitrogen, denoted by A, at high pressure, which is fed into the outer pressure chamber 20*b*, to then emerge, in the form of high-energy jets, indicated by arrows G, in the inner micronization chamber 20*a*, through the channels 20*c* which connect the outer pressure chamber 20*b* with the inner micronization chamber 20*a*.

In this way a system of high-energy jets is generated inside the micronization chamber 20*a*, slanted with respect to the radius of the micronization chamber 20*a*, which determine a vortex and air spiral motion, around the axis of the micronization chamber 20*a* and converging towards a central area of the latter.

This vortex motion in turn causes a continuous collision between the particles of the powdered material P, which in this way are crushed and take on increasingly small dimensions, that is they are micronized.

More particularly, in the micronization chamber 20*a*, due to this vortex motion, the particles of the powdered material P are subject to a centrifugal force which tends to move them towards the periphery of the micronization chamber 20*a* and therefore to maintain them in the micronization area, while the particles are above a certain dimension or are not yet sufficiently crushed.

The same particles, once they have been completely crushed, are instead subjected to a radial force which tends to move them towards the central area of the micronization chamber 20*a*, denoted in the drawings by 20*a*' and a dotted and dashed circle, from where they are evacuated from the collection and evacuation system 40.

Therefore the vortex motion in the micronization chamber operates also as classifier of the particles so as to determine the evacuation thereof, once micronized.

According to an essential feature of the present invention, the micronization chamber 20*a* of the micronizer mill 20, included in the broader micronization apparatus 10, is delimited by respective walls which have at least one porous or filtering portion which is apt to be traversed by a regular flow of a gaseous fluid denoted by F, aimed towards the interior of the micronization chamber 20*a*, so as to avoid the formation of incrustations and/or accumulations of powdered material on this porous portion of the walls which delimit the micronization chamber 20*a* and in the areas adjacent to the micronization chamber 20*a*.

Figure 3:
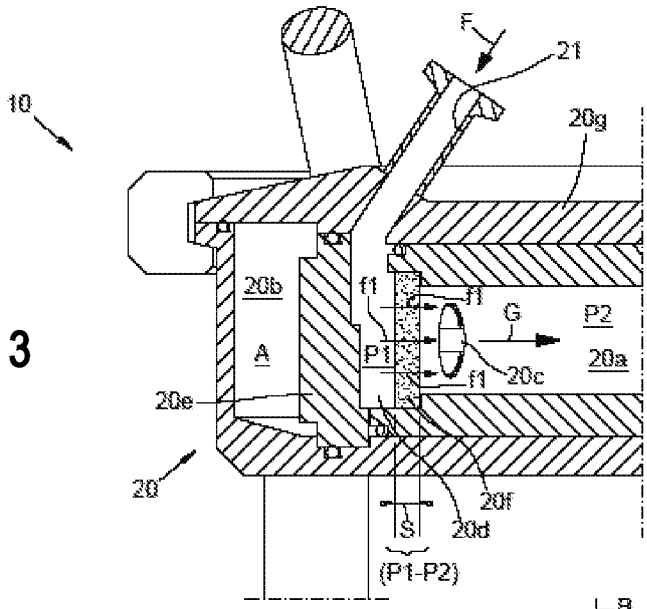
FIG. 3 is a sectioned schematic view on enlarged scale of an area of the micronization apparatus of FIGS. 1 and 2, which has a porous wall apt to be traversed by a flow of gaseous fluid in order to prevent the formation of incrustations and accumulations of powdered material inside a micronization chamber of the micronizer mill, with high-energy jets, included in the same micronization apparatus.

More particularly, for this purpose and as shown in the drawings, the micronizer mill 20 of the micronization apparatus 10 of the invention comprises in addition to the inner micronization chamber 20*a*, of circular shape:

- an intermediate chamber or cavity denoted by 20*d*, of annular shape, that surrounds and externally delimits the inner micronization chamber 20*a* and is placed between the outer pressure chamber 20*b*, of annular shape, and the inner micronization chamber 20*a*, of circular shape,
- a first wall 20*e*, of annular shape, usually in Teflon®, that separates the intermediate chamber 20*d* from the outer pressure chamber 20*b*; and
- a second wall 20*f*, of annular shape, that surrounds and externally delimits the inner micronization chamber 20*a* so as to separate the intermediate chamber 20*d*, of annular shape, from the inner micronization chamber 20*a*, of circular shape.

wherein the intermediate chamber 20*d* is provided in order to be fed by the gaseous fluid F aimed at traversing the porous portion of the walls that delimit the micronization chamber 20*a*, and wherein the second wall 20*f*, of annular shape, that surrounds and delimits externally the inner micronization chamber 20*a* and separates it from the intermediate chamber 20*d*, has this porous or filtering portion provided in order to traversed by the fluid F, as indicated by a plurality of arrows f1 in FIG. 3, so as to avoid, during use and functioning of the micronization apparatus 10, the formation of incrustations and/or accumulations of powdered material inside the micronization chamber 20*a*.

In detail, as shown in the drawings and for example in FIG. 3, the gaseous fluid F which flows through the porous portion of the annular wall 20*f* which separates the intermediate chamber 20*d* from the micronization chamber 20*a* accesses from the outside the intermediate chamber 20*d* via an inlet duct 21 which extends through the outer casing, denoted by 20*g*, of the micronizer mill 20.

As also ascertained by numerous and thorough experimental tests, this regular flow of the gaseous fluid F which traverses the porous wall 20*f* in fact has the effect of preventing in time, that is during the use of the micronization apparatus 10, the powdered material, which is subjected to the micronization process, from depositing or accumulating on the walls of the micronization chamber 20*a* of the micronizer mill 20 and in the areas adjacent to the this micronization chamber 20*a*, as instead usually or at least often takes place in conventional jet mills.

Naturally this gaseous flow that traverses the porous part of the wall 20*f* and which, as mentioned, has the beneficial effect of preventing the formation of accumulations and incrustations inside the micronization chamber 20*a*, is induced by a difference or gradient of pressure between the intermediate chamber 20*d* and the micronization chamber 20*a*.

Figure 4:
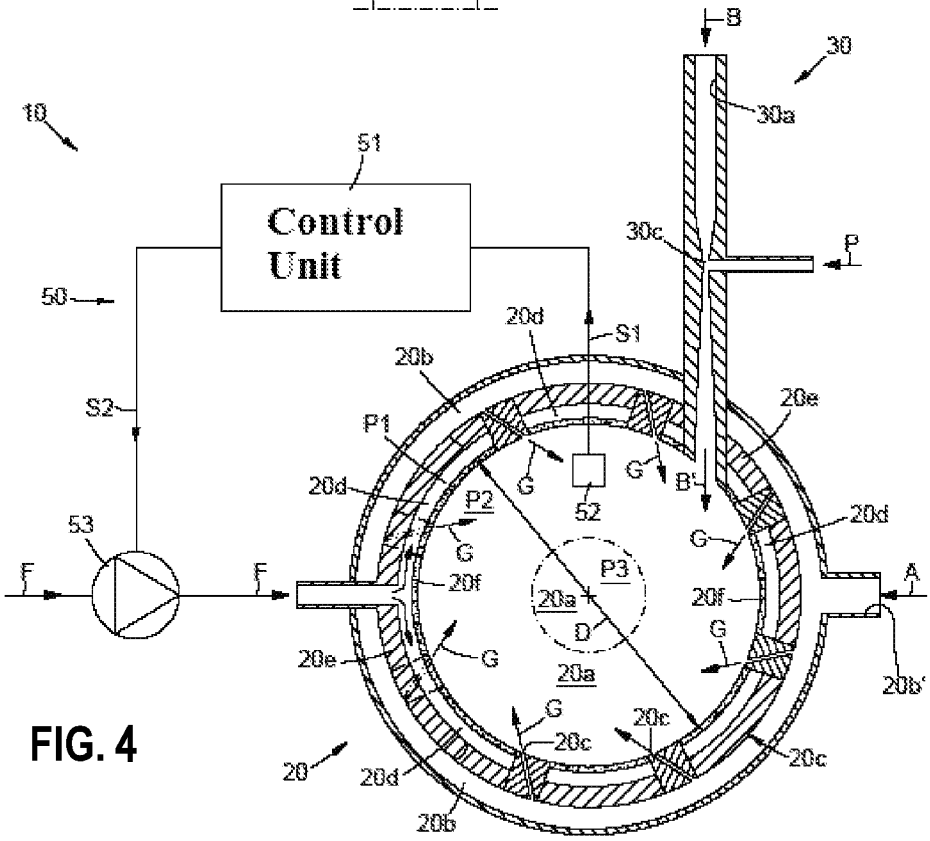
FIG. 4 is a diagram of the micronization apparatus of the invention which shows a circuit of control of the gaseous flow aimed at avoiding the formation of incrustations and accumulations inside the micronizer mill of the micronization apparatus.
Figure 5A:
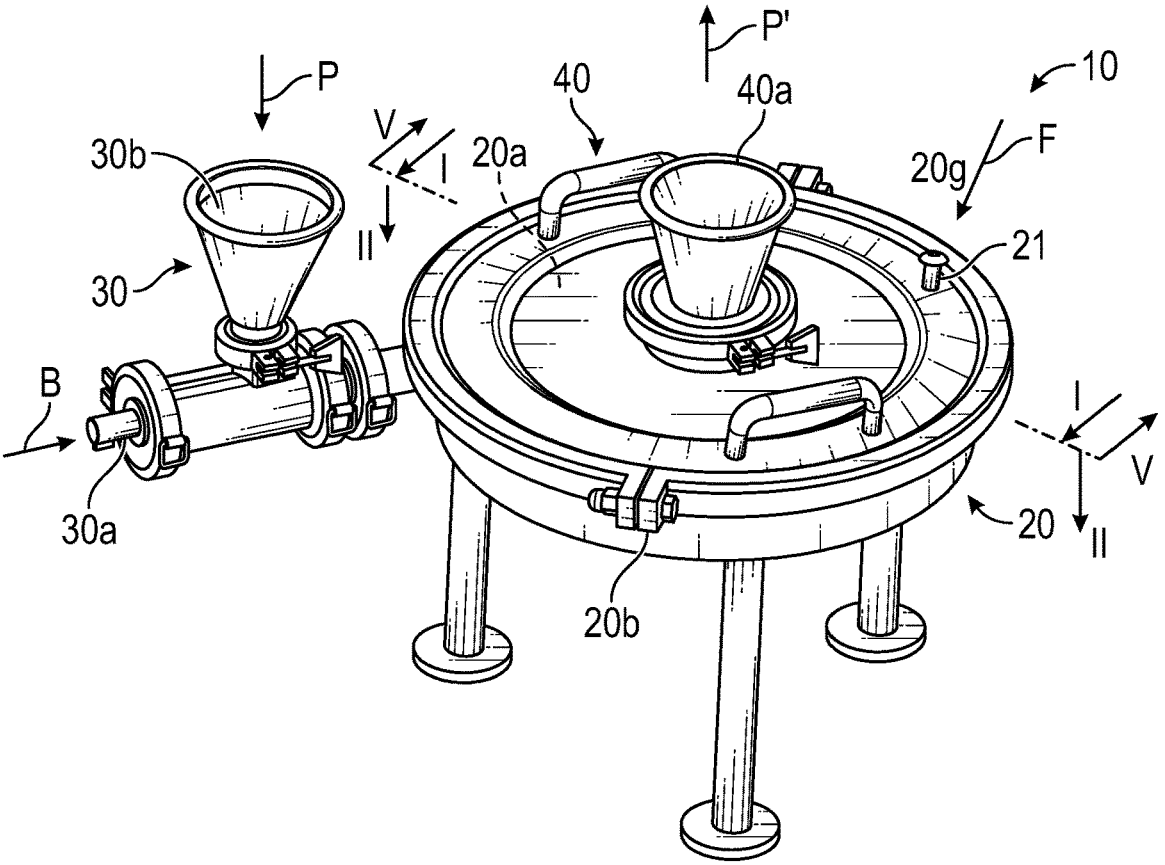
FIG. 5A is a first three-dimensional graphic view which shows the apparatus, according to the present invention, for the micronization of powdered material, comprising a mill with high-energy jets of a gaseous fluid having the capacity to prevent the formation of incrustations and accumulations of powdered material inside the micronizer mill.
Figure 5B:
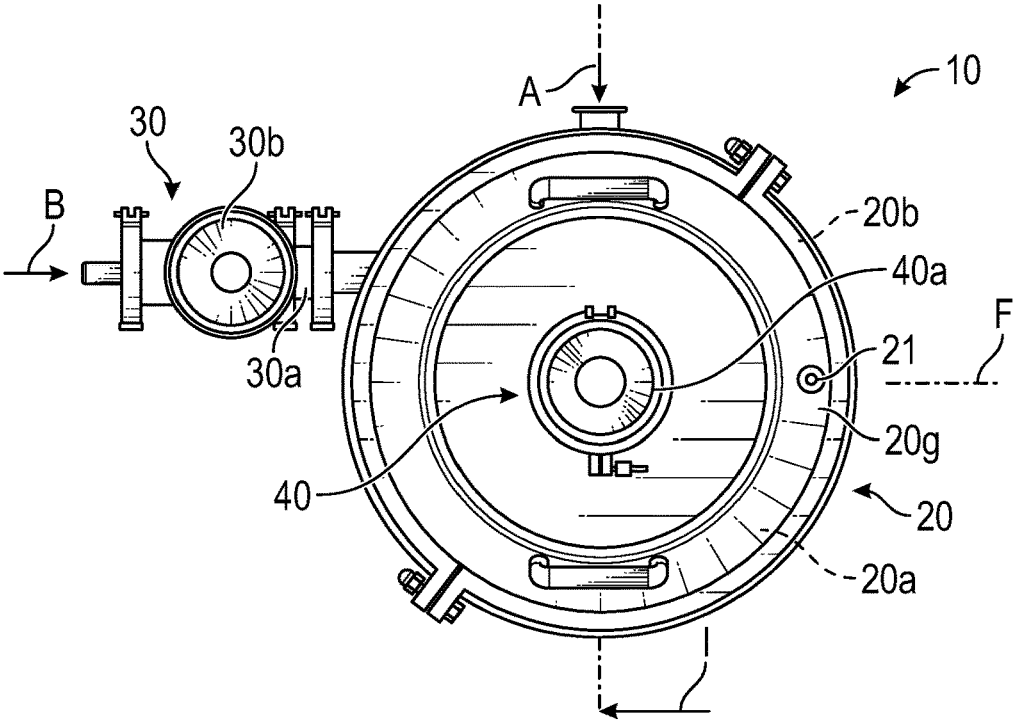
FIG. 5B is a further plan graphic view from above of the micronization apparatus of FIG. 5A.
Figure 5C:
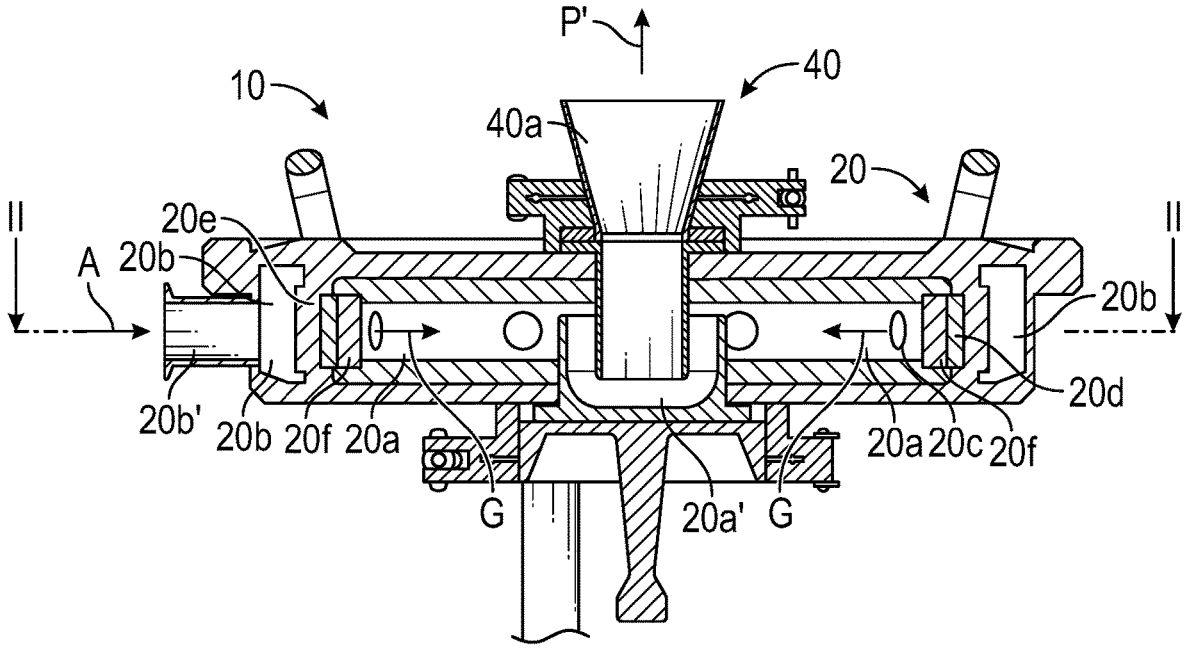
FIGS. 5C and 5D are further graphic views sectioned along the vertical plane defined by line V-V of FIG. 5A, of the micronization apparatus of the invention.
Figure 5D:
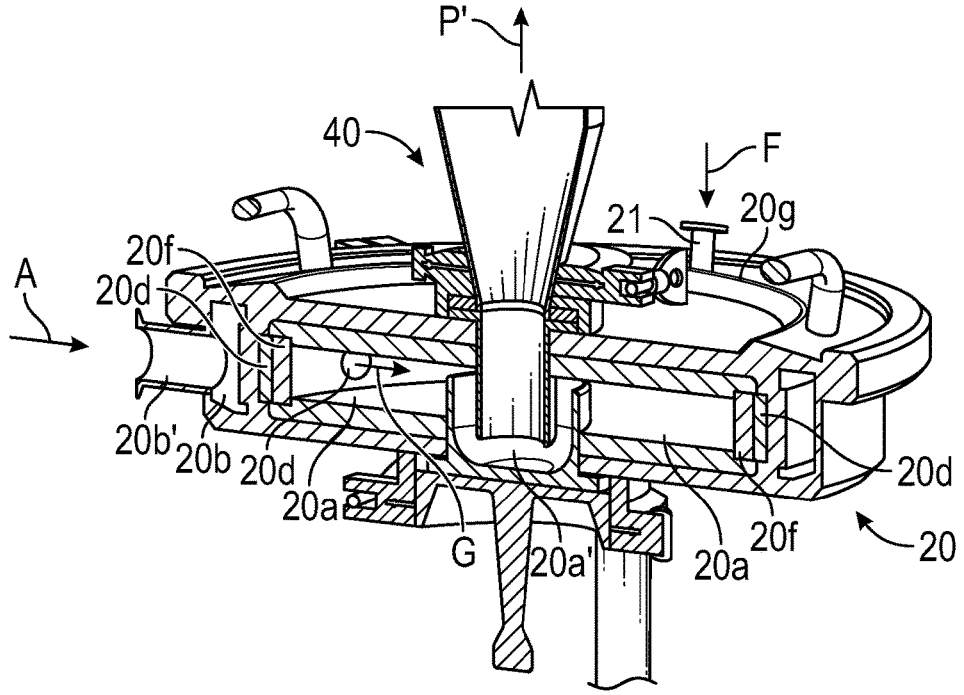
Figure 5E:
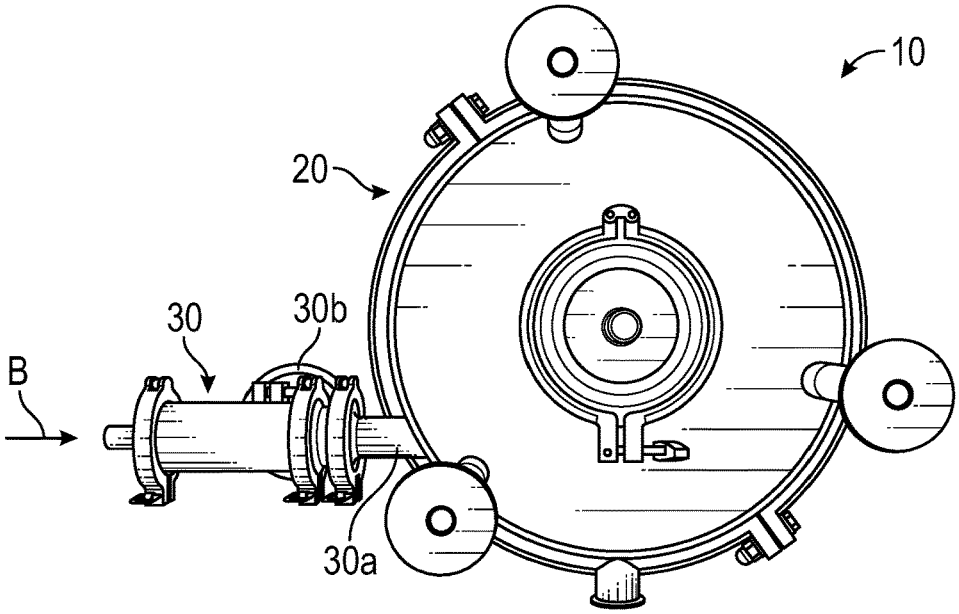
FIG. 5E is a further graphic view from below of the micronization apparatus of FIG. 5A.
Figure 5F:
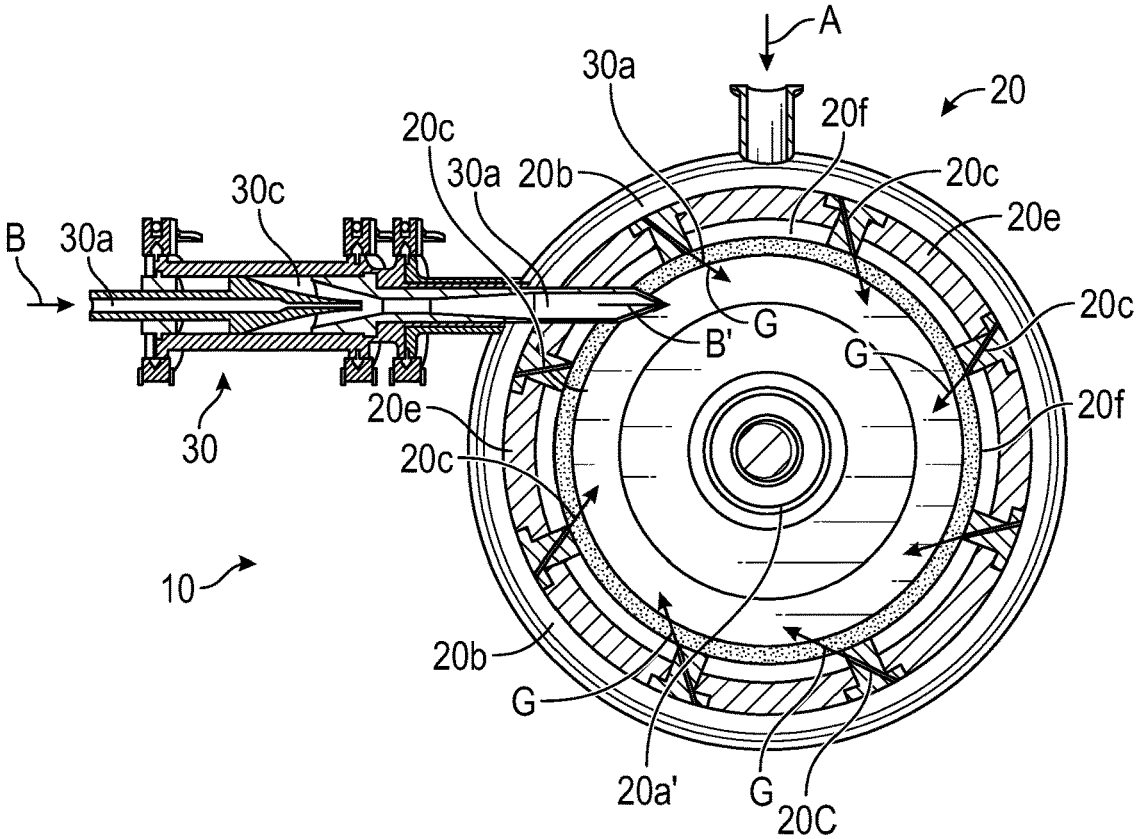
FIG. 5F is a further sectioned graphic view, from above, corresponding to FIG. 2, of the micronization apparatus of FIG. 5A.

In other words, referring to FIGS. 3 and 4, the pressure P1 of the gaseous fluid F, present in the intermediate chamber 20*d*, is higher than the pressure P2, present in the peripheral area of the micronization chamber 20*a* or in the immediate vicinity of the porous wall 20*f*, so that the gaseous fluid F is induced to flow through the porous wall 20*f* by a difference in pressure equal to (P1-P2) which corresponds also to the drop in pressure undergone by the same gaseous fluid F while it traverses the thickness S of this porous wall 20*f*.

Indicatively it has emerged, on the basis of experimental tests, that this flow of fluid F through the porous wall 20*f* can be induced by a pressure P1, of the fluid F, present in the intermediate chamber 20*d*, equal for example to 10 ata, that is 10 kg/cm$^2$ and by a pressure P2, present in the peripheral area of the micronization chamber 20*a* that is in the immediate vicinity of the porous wall 20*f*, slightly higher than the P3 one, usually equal to atmospheric pressure and in any case relatively low, present in the central area 20*a*' of the micronization chamber 20*a*, where the micronized powder P' is collected.

Naturally the numerical pressure values given above are to be understood as relative and not absolute pressure values, that is of pressure with respect to the atmospheric one of 1 bar.

The materials which can be used to make the porous wall 20*f* or a portion thereof can be different, all coming within the scope of the present invention.

For example, mention is made among these possible materials of sintered stainless steel, known by the code AISI 316, currently already used for making sterilising and purifying filter cartridges in the pharmaceutical and food industry, or plastic materials such as PTFE, better known as Teflon®.

In particular as regards PTFE this material is suitable for being advantageously used, taking account of its specific features and technical properties, to make the porous wall 20*f* of the micronization apparatus 10, and for example to make a micronization apparatus according to the invention wherein the gaseous fluid F is subjected to a condition of relative pressure of only 20 mbar in the micronization chamber 20*a*, in order to generate the flow of the gaseous fluid F through this porous wall 20*f*.

It is in any case clear that, by incrementing or in general varying the conditions of pressure in the gaseous fluid F provided to flow through the porous wall 20*f*, it is possible to regulate and obtain the optimal and more convenient rate of the flow of the gaseous fluid F through the same porous wall 20*f*, made in porous PTFE.

In this respect it is also pointed out that currently various types of PTFE are available, for example that known commercially by the registered trademark TEKPORE of the firm GUARNIFLON, with features of porosity such as to meet the specific needs of the present invention in relation to the porous wall 20*f*.

To sum up, at least at the current time, PTFE, that is to say Teflon®, appears to be the best choice for making the porous wall, being above all a material that is easy to work, adapt and model and moreover compatible with the needs and requirements posed by the technology of micronization of powdered material.

As regards sintered steel, this material can for example have a porosity of approximately 1-3 microns.

Finally mention is further made, among the possible materials which can be used to make the porous wall through which the gaseous fluid F flows to avoid the formation of incrustations, of the following:

porous polypropylene;

porous high density polyethylene (HDPE);

porous ceramic materials.

Again the wall 20*f* can also be made, exploiting some recent developments in the technology of materials and of components, with a material that is not exactly porous, that is having a structure, made with a non-porous material, which is characterised by a system of micro-cavities, very fine, in communication one with the other, which allow the passage of the fluid F through the wall 20*f* and make it therefore functionally equivalent to a porous or filtering wall made with a porous material.

For completeness of information an indication is given here below, on an indicative level and with reference to FIGS. 3 and 4, of some of the relevant dimensions and of the respective ranges of variation of the micronization apparatus 10 of the invention:

thickness S of the porous wall 20*f*=2-3 mm, diameter D of the micronization chamber 20*a*=100-300 mm.

Again, always for greater and more complete information, a simple calculation is given here below aimed at showing and giving an idea of the value of the parameters involved in the functioning of the micronization apparatus of the invention 10.

Supposing that the micronization apparatus 10 includes a micronizer mill 20 with a micronization chamber 20*a* having a diameter of 100 mm and delimited laterally by a cylindrical ring just over 1 cm high, it is obtained that the surface of this ring, which corresponds to the porous wall 20*f* which is traversed by the gaseous fluid F, is equal to approximately 50 $cm^2$.

Therefore, assuming that the flow of grinding gas A aimed at generating the fluid jets G with high energy is equal to 800 litres/minute and takes place at approximately 7 bar of relative pressure with respect to the atmospheric pressure, it is obtained that the flow of the gas F which traverses the porous wall 20*f* of the cylindrical ring to reach the grinding chamber 20*b* has to have a flow of at least one tenth and that is equal to approximately 100 litres/minute, which corresponds, taking account of the fact that the surface of the cylindrical ring or of the porous wall is approximately 50 $cm^2$, to a flow or to a flow rate of the gas F through this ring of approximately 2 litres per $cm^2$ and minute.

It is therefore clear, from what is described, that the present invention achieves in full the objects that had been set, and in particular provides a new micronization apparatus or plant, of the type comprising a micronization mill with high-energy jets, which has significant improvements and better performances with respect to the apparatuses, currently known and in use, for the micronization of powders such as those typically intended to be used in the pharmaceutical industry, and which in particular is apt to avoid the formation of irksome and damaging incrustations inside the high-energy jets micronization mill which is included in the micronization apparatus.

Among the substances widely used in the pharmaceutical industry which, as has been found from the numerous and thorough experimental tests performed on prototypes of the micronization apparatus of the invention, have not generated, unlike what often happens using known micronization devices, phenomena of formation of accumulations and incrustations of powdered material inside the micronizer mill, the following are mentioned in particular: Flutamide, Acitretin, Fluticasone, Isoconazole, Isosorbide mononitrate, Nifedipine, Orlistat, Medroxyprogesterone acetate, Triamcino lone.

More particularly the micronization apparatus of the invention has not presented, even after prolonged use, accumulations of powdered material in those critical areas, such as for example the area of the classifier, which in the prior art are instead often affected by this disadvantage and problem.

Variants

Naturally the micronization apparatus 10, described previously, can be the subject of changes, improvements and variants still coming within the scope of the present invention.

For example the porous portion, which is associated with the walls that delimit the micronization chamber 20*a* of the micronizer mill 20 and that is apt to be traversed by the fluid F, can assume various configurations, or be associated with different areas of the walls that delimit the micronization chamber 20*a* and for example be associated with the respective base wall, in order to avoid the formation of incrustations of powdered material inside the same micronization chamber 20*a*.

For example, in this embodiment, the base wall of the micronization chamber can be associated with a cavity which receives from the outside the fluid F which is intended to flow through this base wall, so as to avoid that in time deposits and incrustations of powdered material are formed thereon.

The porous portion can also be associated, as well as with the lateral annular wall and/or the lower base wall, also with the upper wall, opposite to the base one, of the micronization chamber.

In general this porous portion can be formed in any area of the walls that delimit the micronization chamber, in which, as ascertained experimentally and through the effect of the particular fluid dynamic conditions present in the same micronization chamber, deposits and incrustations of the powdered material tend to form.

In this way, that is by creating the porous portion or portions in the most appropriate areas of the walls that delimit the inner micronization chamber, the apparatus of the invention, for the micronization of a material or of a powdered product, is able to ensure and guarantee, unlike those already known, a total absence, during use, of incrustations and/or deposits of powdered material on the walls of the same inner micronization chamber.

For reasons of brevity, these variants in which the porous portion can be formed in any area, considered appropriate, of the walls of the inner micronization chamber, will not be shown in the drawings, being implicit or obviously inferable from the embodiment 10, described previously, of the apparatus of the invention for the micronization of a powdered material.

Further, the gaseous fluid A that feeds the outer pressure chamber 20*b* to generate the high-energy jets G in the micronization chamber 20*a*, the gaseous fluid B that feeds the feed duct 30*a* to draw the powder P to be micronized into the micronization chamber 20*a*, and the fluid F that feeds the intermediate chamber or annular cavity 20*d* to generate the flow towards the micronization chamber 20*a* through the porous portion 20*f* of the walls that delimit the same micronization chamber 20*a*, can be different one from the other, this possibility being in particular allowed by the fact that the pressure chamber 20*b* and the cavity 20*d* are separate and distinct one from the other and are associated with respective systems for feeding of the gaseous fluid, also distinct one from the other.

For example the fluid F that feeds the cavity 20*d* could be constituted by nitrogen or air, like the fluid A that feeds the outer pressure chamber 20*b*.

In this respect it is in any case pointed out that, although it is possible to differentiate the two fluids, respectively the fluid A aimed at producing the high-energy gaseous jets and the fluid F aimed at flowing through the porous wall in order to avoid the formation of incrustations inside the micronization chamber 20*b*, the preferred solution appears to be that of adopting the same type of fluid, in particular air or nitrogen, for the two fluids A and F.

In any case nitrogen, being an inert gas, is to be considered, precisely on account of this property thereof of being inert and therefore of not participating in chemical reactions, the preferred and elective gaseous fluid A for the generation of high-energy gaseous jets and therefore for performing the micronization of the powdered material.

Moreover nitrogen also appears suitable for constituting the gaseous fluid F that traverses the porous wall 20*f*.

In any case air in turn also appears to be a very suitable gas for being used to flow through the porous wall and therefore prevent the formation of incrustations.

Further, FIG. 4 illustrates an interesting improvement of the micronization apparatus of the invention including a control circuit, denoted overall by 50, apt to control the flow of the second gaseous fluid F through the porous wall 20*f* and in particular comprising an electronic control unit 51 and a pressure sensor 52, placed inside the micronization chamber 20*b* of the micronizer mill 20, having the function of detecting the pressure present inside the respective micronization chamber 20*a*.

In functioning the control unit 51 receives from the pressure sensor 52 a signal S1 indicating the pressure present inside the micronization chamber 20*b* and generates a corresponding signal S2 aimed at controlling a pump 53 that feeds the fluid F, at an appropriate rate and pressure, to the cavity 20*d* so as to keep under control, that is in accordance with a preset trend, the pressure inside the micronization chamber 20*b* and therefore also the flow of the fluid F that traverses the porous wall 20*f*.

Figure 6:
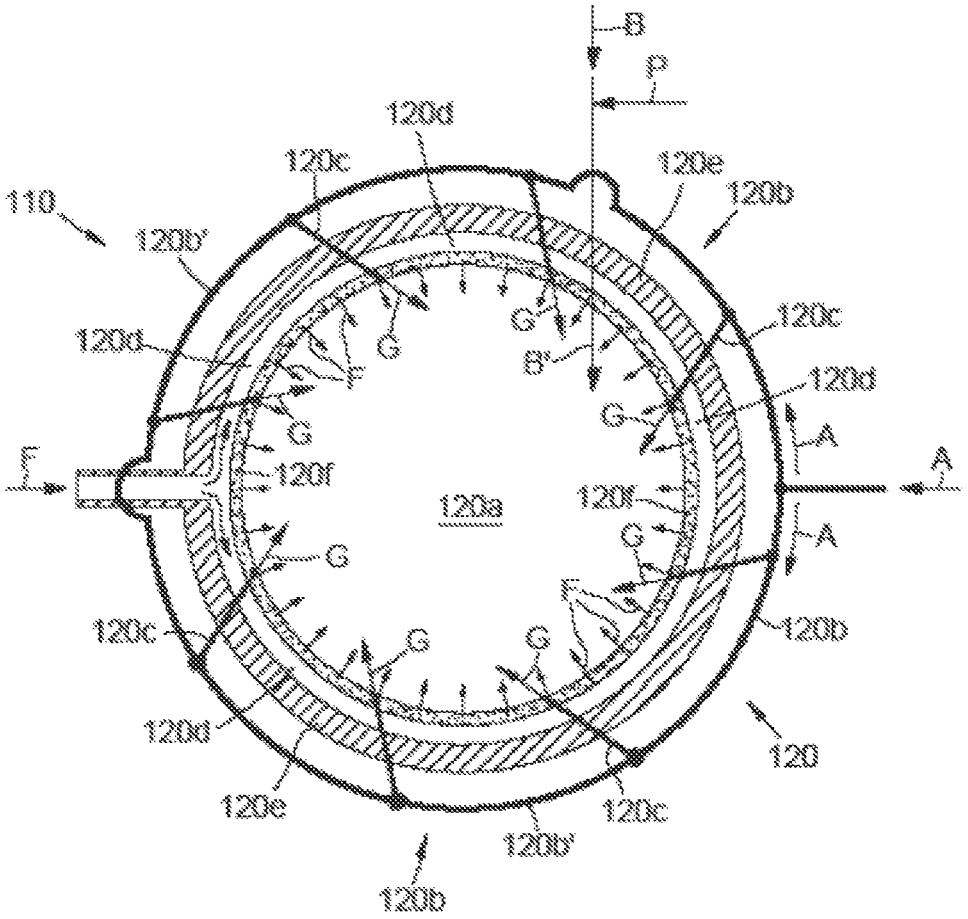
FIG. 6 is a diagram of the micronization apparatus of the invention in a further embodiment with respect to that of FIGS. 1-3 and of the corresponding graphic views of FIGS. 5A-5F.
Figure 6A:
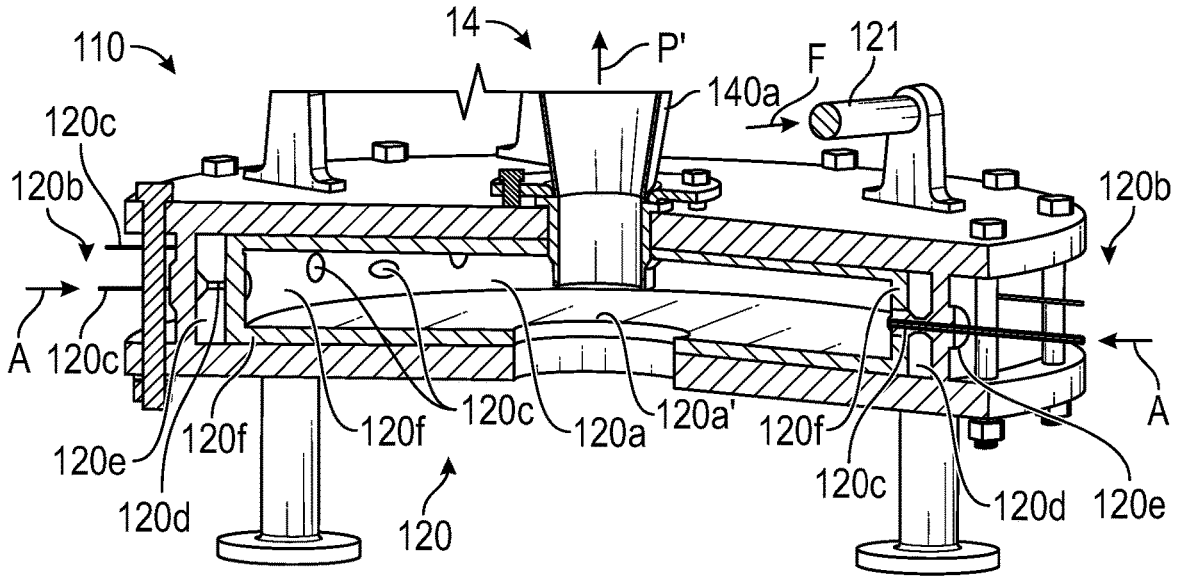
FIGS. 6A-6C are sectioned three-dimensional graphic views of the further embodiment of FIG. 6 of the micronization apparatus of the invention.
Figure 6B:
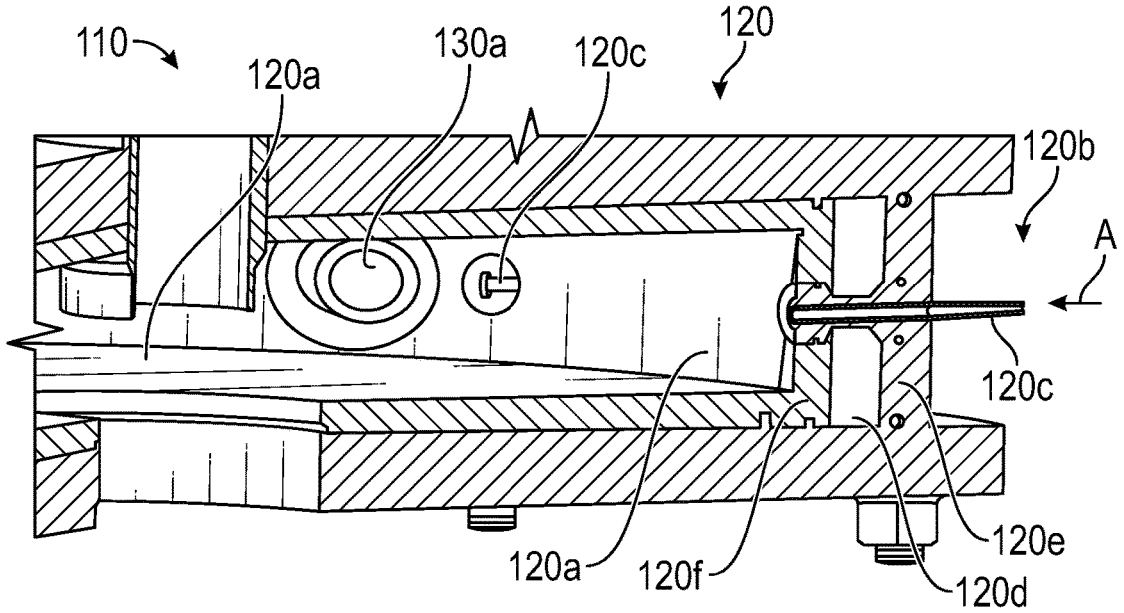
Figure 6C:
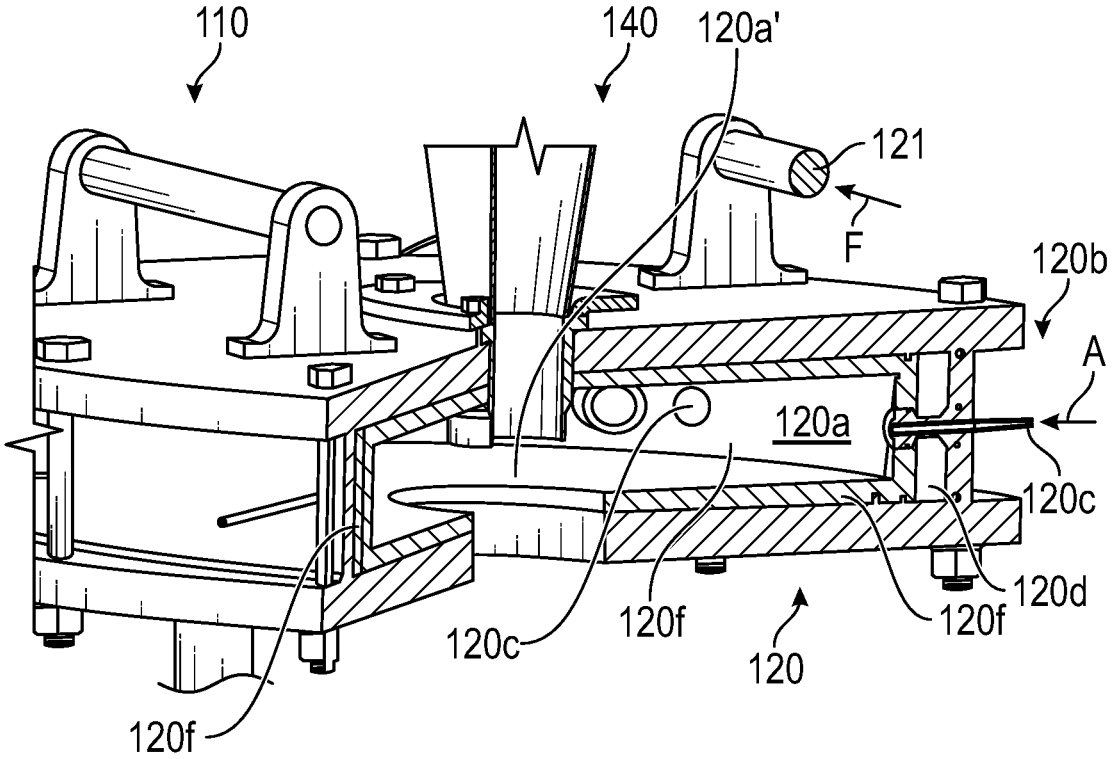

The diagram of FIG. 6 and the photos of FIGS. 6A-6C refer to a further variant, denoted overall by 110, of the micronization apparatus of the invention, in which the parts and the features corresponding to those of the preferred embodiment 10, described previously, are indicated for reasons of clarity with reference numerals incremented by 100 with respect to those of this previous embodiment 10.

In detail, in this further embodiment, the micronizer mill 120, included in the apparatus 110 for the micronization of a powdered material or product, comprises as well as the inner micronization chamber 120*a*, of circular shape, and alternatively to the pressure chamber 20*b*, included in the embodiment 10:

- a system of channels or ducts, denoted overall by 120*b*, apt to be fed by the first gaseous fluid A, pressurised, wherein this system of channels 120*b* has an annular configuration around the inner micronization chamber 120*a* and comprises in turn an outer channel 120*b*', with ring shape, and a plurality of channels 120*c*, connected at one end to the outer annular channel 120*b*' having the function of conveying the first gaseous fluid A, pressurised, inside the inner micronization chamber 120*a*, so as to generate the high-energy jets G that cause the micronization of the powdered material P.

Moreover the micronizer mill 120 of the micronization apparatus 110 comprises, similarly to the micronizer mill 20 of the micronization apparatus 10:

- an intermediate chamber or cavity 120*d*, with annular shape, which is placed between a ring 120*b*' of the system of channels 120*b* and the micronization chamber 120*a* and is provided to be fed by the second gaseous fluid F; and
- a wall 120*f*, of annular shape, that surrounds and externally delimits the inner micronization chamber 120*a* and separates the intermediate chamber 120*d*, of annular shape, from the inner micronization chamber 120*a*, of circular shape, of the micronizer mill 120;

wherein this wall 120*f*, of annular shape, which delimits the inner micronization chamber 120*a*, has the porous or filtering portion through which the second gaseous fluid F flows, having the function of avoiding the formation of incrustations and/or accumulations of powdered material inside the micronization chamber 120*a* and in the adjacent areas.

In this variant 110 the channels 120*c* that convey and feed the first gaseous fluid A, pressurised, to the inner micronization chamber 120*a* can be integrated, similarly to the channels or through holes 20*c* included in the embodiment 10 and shown in FIG. 2, in actual nozzles, each one provided with a respective metal body which extends through the wall 120*e* that delimits externally the intermediate chamber 120*d* and the wall 120*f* that delimits the micronization chamber 120*a*.

Further Improvements

The possibility is also pointed out, always to be considered within the scope of the improvements and of the variants of the present invention, of using a gaseous fluid, in particular nitrogen, at a temperature below zero, that is less than 0° C., in order to generate the high-energy gaseous jets that micronize the powdered material in the micronizer mill 20.

This possible improvement on the basis of which the gaseous fluid that generates the high-energy jets is used at a relatively low temperature has the advantage of controlling the temperature inside the micronization chamber in order to allow the grinding or micronization of active substances in cryogenic or cold conditions, when this is required for reasons of chemical and physical stability or to facilitate and improve the same process of micronization, acting on the features of hardness, influenced by the cold, of the particles to be micronized.

These conditions, that is operating in a condition of cold and at a relatively low temperature, can be applied to only the grinding fluid or extended also to the fluid that flows through the porous wall, taking account of the specific nature of the micronization process and of the features of the active substance to be ground.

In this way the two gaseous fluids, in particular nitrogen and air, provided to generate the high-energy gaseous jets aimed at micronizing the powdered material and to traverse the porous wall so as to avoid the formation of incrustations inside the micronizer mill, are used in cryogenic function, that is to control the temperature inside the micronization chamber of the micronizer mill, so as to improve and optimise the process of micronization in particular as regards the quality of the micronized end product and the capacity of the micronization apparatus to avoid and contrast the formation in time of incrustations.

The invention claimed is:

1. An apparatus for micronization of a powdered material or product (P), or a material containing particles, comprising:

a micronizer mill with jets of a first gaseous fluid (A);

wherein the micronizer mill comprises an inner micronization chamber of circular shape, in which the powdered material or product (P) is micronized through collisions between the respective particles caused by the jets (G) of the gaseous fluid (A);

wherein the micronization chamber of the micronizer mill is delimited by respective inner walls which have at least one porous or filtering portion configured to be crossed by a regular flow (f1), of a second gaseous fluid (F), directed toward the interior of the micronization chamber, so as to avoid the formation of incrustations and/or powdered material accumulations within the micronization chamber, wherein the micronizer mill in turn comprises in addition to the inner micronization chamber, of circular shape:

an outer pressure chamber, of annular shape, arranged around the inner micronization chamber, of circular shape, configured to be fed by the first gaseous fluid (A), under pressure; and a plurality of ducts or through holes which connect the outer pressure chamber, of annular shape, to the inner micronization chamber, of circular shape, and configured to convey the first gaseous fluid (A) under pressure coming from the outer pressure chamber, so as to generate, within the inner micronization chamber, the jets (G) being configured to cause the micronization of the powdered material (P);

the apparatus further comprising:

an intermediate chamber or hollow space, of annular shape, arranged between the outer pressure chamber, of annular shape, and the inner micronization chamber, of circular shape, with the intermediate chamber being configured to be fed by the second gaseous fluid (F) directed to cross the porous or filtering portion;

wherein the inner walls comprise a first wall, of annular shape, separating the intermediate chamber from the outer pressure chamber; and a second wall, of annular shape, surrounding and externally delimiting the inner micronization chamber and separating the intermediate chamber, of annular shape, from the inner micronization chamber, of circular shape, wherein the second wall, of annular shape comprises the porous or filtering portion configured to be crossed by the second gaseous fluid (F) in order to avoid the formation of incrustations and/or powdered material accumulations within the inner micronization chamber.

2. The apparatus for the micronization of a powdered material or product according to claim 1, wherein the micronizer mill in turn comprises in addition to the inner micronization chamber, of circular shape:

a channel system configured to be fed by the first gaseous fluid (A), under pressure, which channel system extends annularly around the inner micronization chamber and comprising a plurality of channels directed to convey the first gaseous fluid (A), under pressure, inside the inner micronization chamber, so as to generate the jets (G) that cause the micronization of the powdered material (P);

the intermediate chamber or hollow space, of annular shape, arranged within a ring of the channel system and the inner micronization chamber, the intermediate chamber configured to be fed by the second gaseous fluid (F) directed to cross the porous portion.

3. The apparatus for micronization of a powdered material or product according to claim 1, comprising a feed system, including in turn a feed duct, for feeding to the micronization chamber the powdered material (P) to be micronized, wherein the feed duct extends through the intermediate chamber provided to be fed by the second gaseous fluid (F) which then passes through the porous portion.

4. The apparatus for the micronization of a powdered material or product according to claim 1, wherein the first gaseous fluid (A), directed to generate the jets (G) that cause the micronization of the powdered material (P), and the second gaseous fluid (F), directed to cross the porous portion in order to avoid the formation of incrustations and/or powdered material accumulations inside the micronization chamber are both constituted by the same kind of gaseous fluid.

5. The apparatus for micronization of a powdered material or product according to claim 1, wherein the apparatus is configured to flow the second gaseous fluid (F) through the second wall, which delimits the inner micronization chamber and comprises the porous portion, by a pressure difference (P1-P2), between the pressure (P1) present in the intermediate chamber and the pressure (P2) present in the micronization chamber, such that the second fluid (F) accesses the interior of the micronization chamber at a pressure (P2) higher than that (P3) present in the central region of the micronization chamber.

6. The apparatus for micronization of a powdered material or product according to claim 1, wherein the porous portion, through which the second gaseous fluid (F) flows, is formed along a portion of the second wall that laterally delimits the micronization chamber.

7. The apparatus for micronization of a powdered material or product according to claim 1, wherein the porous portion, through which the second gaseous fluid (f) flows, is formed along a lower portion of the micronization chamber.

8. The apparatus for micronization of a powdered material or product according to claim 1, wherein the porous portion, through which the second gaseous fluid (F) flows, is formed along an upper portion of the micronization chamber.

9. The apparatus for micronization of a powdered material or product according to claim 1, wherein the porous or filtering portion comprises a material that has a porosity of 1-3 microns.

10. The apparatus for micronization of a powdered material or product according to claim 1, wherein the porous or filtering portion comprises a material having micro interstices, in communication one with the other, and configured to allow the passage, through the porous or filtering portion, of the second gaseous fluid (F) that accesses the interior of the micronization chamber to prevent the formation of incrustations.

11. The apparatus for micronization of a powdered material or product according to claim 1, wherein the first gaseous fluid (A) directed to generate the gaseous jets (G) in the micronizer mill and/or the second gaseous fluid (F), which flows through the porous or filtering portion are configured to operate at a temperature that is less than 0° C.

12. The apparatus of claim 1 wherein the first gaseous fluid (A) comprises nitrogen.

13. A process for micronizing a powdered material or product (P) or a material containing particles by means of a micronizer mill with jets of a first gaseous fluid (A), avoiding at the same time the formation of incrustations and/or powdered material accumulations inside an inner micronization chamber of the micronizer mill, the powdered material or product being micronized in the micronization chamber the method comprising the following steps:

providing the micronizer mill comprising the micronization chamber;

configuring the inner micronization chamber, of the micronizer mill, in such a way that it is delimited by respective walls that have at least one porous or filtering portion; and feeding a regular flow (f1) of a second gaseous fluid (F) through the porous or filtering portion, from the outside towards the inside of the inner micronization chamber, the micronizer mill further comprising:

an intermediate chamber or hollow space, of annular shape, arranged between an outer pressure chamber, of annular shape, and the inner micronization chamber, of circular shape, with the intermediate chamber being configured to be fed by the second gaseous fluid (F) directed to cross the porous or filtering portion;

wherein the respective walls comprise a first wall, of annular shape, separating the intermediate chamber from an outer pressure chamber; and a second wall, of annular shape, surrounding and externally delimiting the inner micronization chamber and separating the intermediate chamber, of annular shape, from the inner micronization chamber, of circular shape, wherein the second wall, of annular shape comprises the porous or filtering portion configured to be crossed by the second gaseous fluid (F) in order to avoid the formation of incrustations and/or powdered material accumulations within the inner micronization chamber.

14. The process according to claim 13, wherein the powdered material or product (P) or a material containing particles micronized with the process comprises Flutamide, Acitretin, Fluticasone, Isoconazole, Isosorbide mononitrate, Nifedipine, Orlistat, Medroxyprogesterone acetate, Triamcinolone, Desogestrel, Eplerenone, or any mixture thereof.

15. The process according to claim 13, wherein the first and second gaseous fluid (A, F), respectively provided for generating the jets (G) that cause the micronization of the powdered material (P) and for flowing through the porous portion in order to avoid the formation of incrustations and/or powdered material accumulations inside the micronization chamber, are both constituted by the same kind of gaseous fluid.

16. An apparatus for micronization of a powdered material or product (P), or a material containing particles, comprising:

a micronizer mill with jets of a first gaseous fluid (A);

wherein the micronizer mill comprises an inner micronization chamber of circular shape, in which the powdered material or product (P) is micronized through collisions between the respective particles caused by the jets (G) of the gaseous fluid (A);

wherein the micronization chamber of the micronizer mill is delimited by respective inner walls which have at least one porous or filtering portion configured to be crossed by a regular flow (f1), of a second gaseous fluid (F), directed toward the interior of the micronization chamber, so as to avoid the formation of incrustations and/or powdered material accumulations within the micronization chamber, wherein the micronizer mill in turn comprises in addition to the inner micronization chamber, of circular shape:

a channel system configured to be fed by the first gaseous fluid (A), under pressure, which channel system extends annularly around the inner micronization chamber and comprising a plurality of channels directed to convey the first gaseous fluid (A), under pressure, inside the inner micronization chamber, so as to generate the jets (G) that cause the micronization of the powdered material (P);

the apparatus for micronization further comprising:

an intermediate chamber or hollow space, of annular shape, arranged between a ring of the channel system and the inner micronization chamber, the intermediate chamber configured to be fed by the second gaseous fluid (F) directed to cross the porous portion; and a first wall of the inner walls having an annular shape and surrounding and externally delimiting the inner micronization chamber and separating the intermediate chamber, of annular shape, from the inner micronization chamber, of circular shape, wherein the first wall comprises the porous or filtering portion provided to be crossed by the second gaseous fluid (F), in order to avoid the formation of incrustations and/or powdered material accumulations within the inner micronization chamber.

17. The apparatus for micronization of a powdered material or product according to claim 16, wherein the porous portion, through which the second gaseous fluid (F) flows, is formed along a portion of the first wall that laterally delimits the micronization chamber.

18. The apparatus for micronization of a powdered material or product according to claim 16, wherein the porous portion, through which the second gaseous fluid (f) flows, is formed along a lower portion of the micronization chamber.

19. The apparatus for micronization of a powdered material or product according to claim 1, wherein the porous portion, through which the second gaseous fluid (F) flows, is formed along an upper portion of the micronization chamber.

20. The apparatus for micronization of a powdered material or product according to claim 16, wherein the porous or filtering portion comprises a material that has a porosity of 1-3 microns.

* * * * *